US005695365A

United States Patent [19]

Kennedy et al.

[11] Patent Number: 5,695,365

[45] Date of Patent: Dec. 9, 1997

[54] COMMUNICATION COAXIAL PATCH CORD ADAPTER

[75] Inventors: James P. Kennedy; Herbert G. Jones, both of Spokane, Wash.

[73] Assignee: Telect, Inc., Liberty Lake, Wash.

[21] Appl. No.: 372,507

[22] Filed: Jan. 13, 1995

[51] Int. Cl.[6] ..... H01R 13/00

[52] U.S. Cl. ..... 439/638; 439/578

[58] Field of Search ..... 439/638, 675, 439/578, 581

[56] References Cited

U.S. PATENT DOCUMENTS

| | | | |
|---|---|---|---|
| 4,336,974 | 6/1982 | Wilson | 439/675 |
| 4,619,496 | 10/1986 | Forney, Jr. et al. | 439/675 |
| 4,687,279 | 8/1987 | Holland et al. | 439/638 |
| 4,846,731 | 7/1989 | Alwine | 439/675 |
| 5,217,391 | 6/1993 | Fisher, Jr. | 439/578 |
| 5,439,386 | 8/1995 | Ellis et al. | 439/578 |

OTHER PUBLICATIONS

"Adaptors–Patch Plug to BNC/TNC"; Product Catalog, Trompeter Electronics, Inc., p. 18.

"Probe Plug–BNC Rear Access"; Product Catalog, Trompeter Electronics, Inc., p. 18.

"BNC Pads", Product Catalog, Trompeter Electronics, p. 18.

"Miniature Patch Jack 50Ω TPS Jack", Product Catalog, Trompter Electronics, Inc., p. 23.

"Adaptor–50Ω Miniature Patch Plug to 50Ω TPS Jack", Product Catalog, Trompeter Electronics, Inc., p. 23.

"Adaptor–50Ω Miniature Patch Plug to 50Ω BNC Jack", Product Catalog, Trompeter Electronics, Inc., p. 23.

"Miniature Patch Jack 75Ω TPS, Mini WECo Type", Product Catalog, Trompeter Electronics, Inc., p. ??.

"Adaptor–75Ω Miniature Patch Plug (mini WECo Type) to 75Ω BNC", Product Catalog, Trompeter Electronics, Inc. p. ??.

"Patch Jack, Self–Terminating BNC", Product Catalog, Trompeter Electronics, Inc., p. 15.

"Patch Jack–BNC", Product Catalog, Trompeter Electronics, Inc., p. 14.

"Patch Jack–TNC", Product Catalog, Trompeter Electronics, Inc., p. 14.

*Primary Examiner*—Paul T. Sewell
*Assistant Examiner*—Luan K. Bui
*Attorney, Agent, or Firm*—Wells, St. John, Roberts, Gregory & Matkin, P.S.

[57] ABSTRACT

A communication coaxial patch cord adapter 40 is described having a jack sleeve section 44 for receiving a jack patch plug 22. The adapter 40 has a male BNC socket section 46 for receiving a female BNC connector 16. A central shaft 110 extends between the sections 44 and 46 with an inner jack sleeve 116 formed on one end and an inner BNC male pin 124 on the other end. A BNC bayonet locking sleeve 90 is rotatably mounted on the male BNC socket section 46 to lock the adapter firmly to the BNC connector 16.

8 Claims, 3 Drawing Sheets

COMMUNICATION COAXIAL PATCH CORD ADAPTER

TECHNICAL FIELD

This invention relates to communication coaxial patch cord adapters that are particularly adapted for use with standard mini-WECO jack patch cords.

BACKGROUND OF THE INVENTION

Frequently in the communications industries of telecommunication and broadcast, it is desirable to interconnect different units of communication or test equipment that have different types of connectors. Often it requires the use of a specialized communication patch cord having different type connectors on the opposite ends to match the connectors of the equipment.

For example, as illustrated in FIG. 1, it may be desirable to interconnect one or more coaxial communication circuits that are terminated at a coaxial patch jack panel 10 with one or more coaxial communication circuits of a BNC panel 12. Often the BNC panel 12 may be present on the front of special communication test equipment designed to analyze the signals being transmitted over the communication circuits. Frequently the coaxial jack panel 10 has an array of mini-WECO patch jacks 14 with each patch jack 14 associated with a designated communication circuit. The BNC panel 12 may have one or more female BNC connectors 16.

Frequently, a special patch cord 18 is manufactured for the special use of interconnecting a coaxial patch jack 14 with a female BNC connector 16. The special patch cord 18 has an intermediate coaxial cable body 20 with a coaxial patch jack plug (mini-WECO) 22 mounted at one end to plug into a patch jack 14 on panel 10 and a coaxial male BNC connector 24 mounted at the other end for receiving the female BNC connector 16 on the panel 12.

Although the special patch cord 18 is effective, it requires the manufacture, storage and inventoring of specialized patch cords 18 when patching between a coaxial patch jack panel 10 and a BNC panel 12. Invariably, a communication worker/tester making the physical interconnection has a common mini-WECO jack plug patch cable, but does not have the specialized patch cord 18 with him/her when the need arises. Consequently, the worker has to delay his work until a specialized patch cord is found or use another more time-consuming routing or patching procedure, even though a common standard jack plug patch cord was close at hand or in the worker's toolbox.

One of the objects and advantages of this invention is to eliminate the need for specialized patch cords 18 in favor of using a common standard mini-WECO jack plug patch cord 30 illustrated in FIG. 2 to interconnect a coaxial patch jack panel 10 and a BNC panel 12.

These and other objects and advantages will become apparent upon reviewing the following detailed description of a preferred embodiment along with the accompanying drawings.

BRIEF DESCRIPTION OF THE DRAWINGS

Preferred embodiments of the invention are described below with reference to the accompanying drawings, which are briefly described below.

FIG. 4 is a longitudinal cross-sectional view of the coaxial adapter illustrated in FIG. 3.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
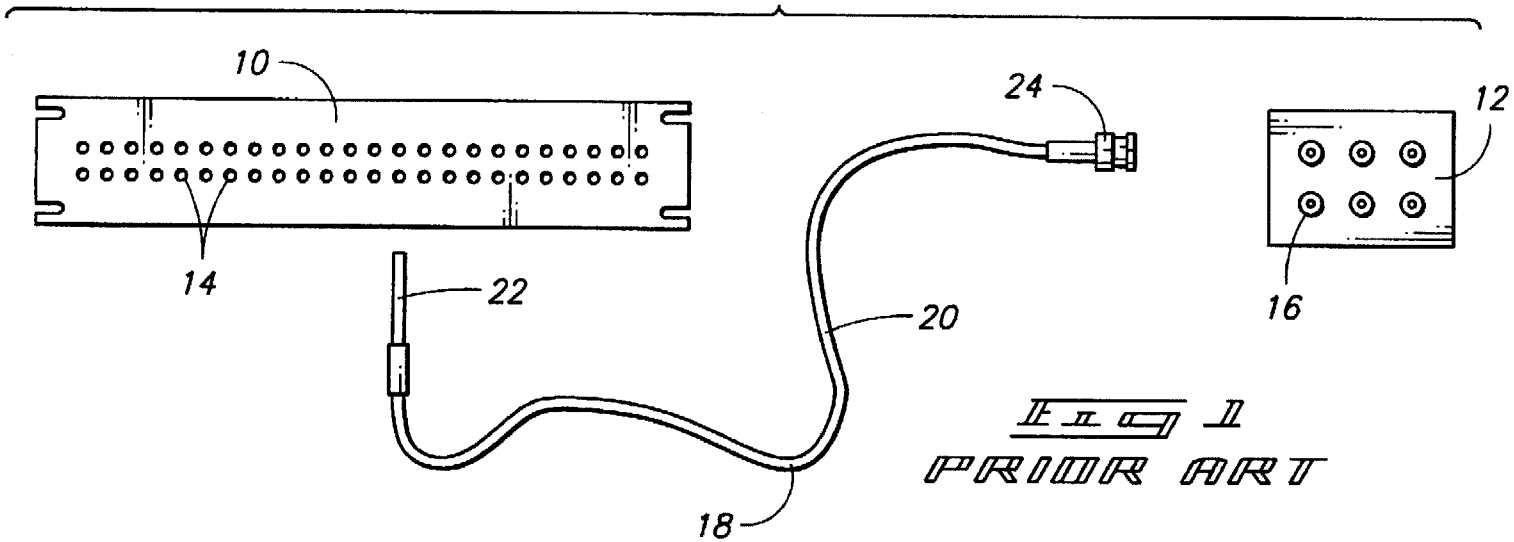
FIG 1 PRIOR ART
FIG. 1 is a schematic view of a communication jack panel and a communication BNC panel with a specialized prior art coaxial jack plug patch cable for coaxially interconnecting coaxial communication circuits of the two panels.
Figure 2:
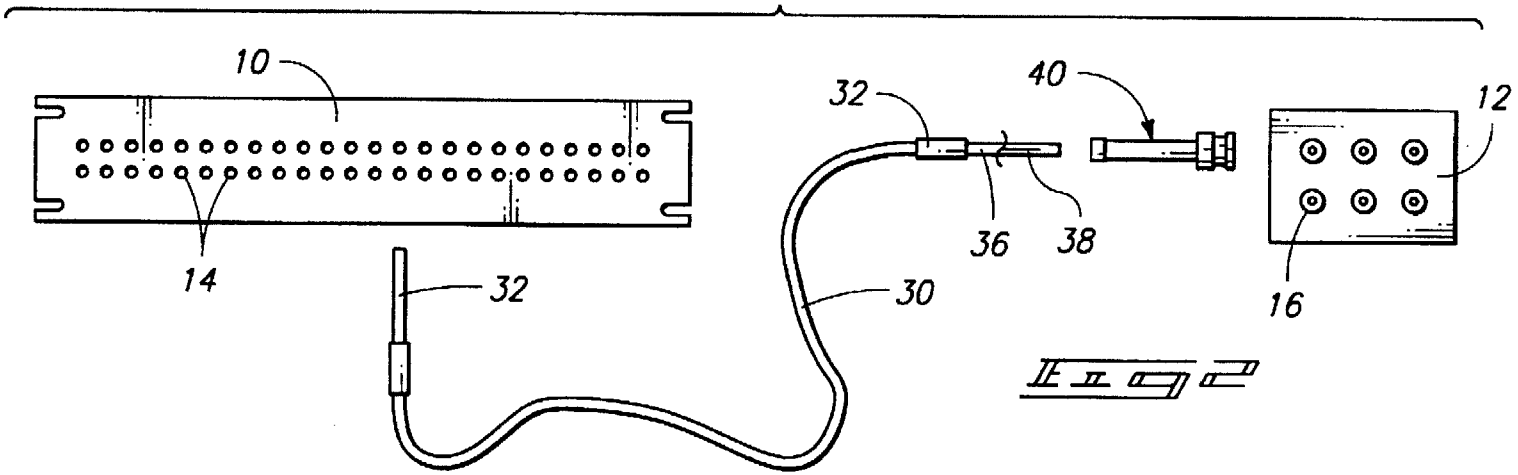
FIG. 2 is a schematic view similar to FIG. 1, except showing the use of a common standard mini-WECO jack plug patch cable with a preferred embodiment of the Applicant's coaxial adapter for interconnecting the coaxial communication circuits of the two panels.
Figure 3:
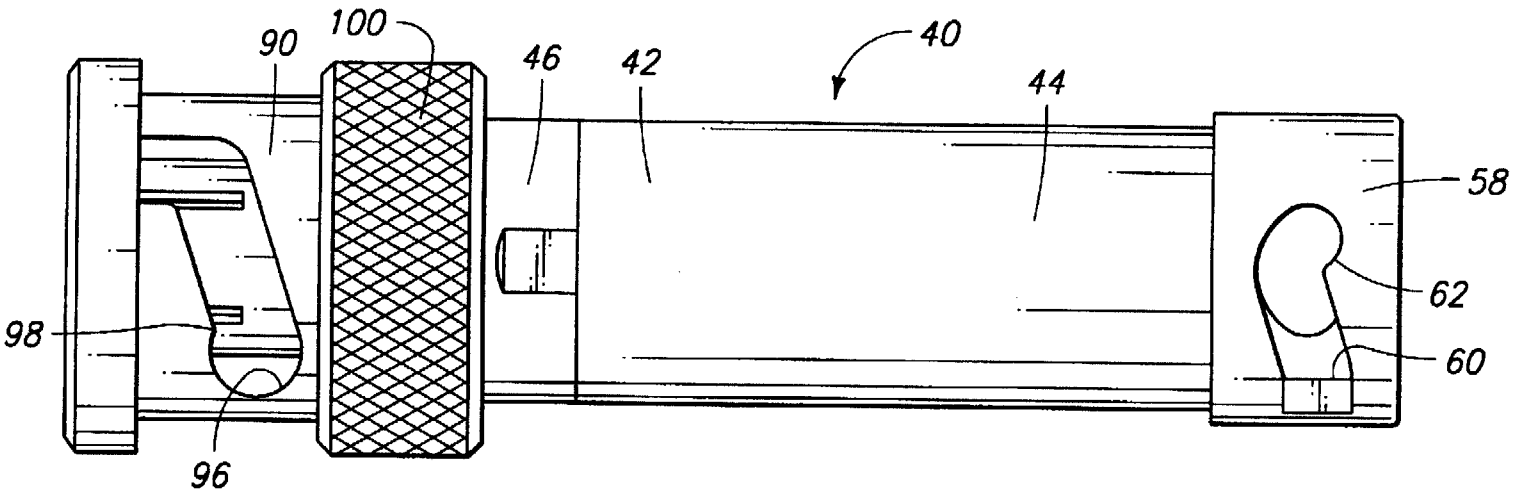
FIG. 3 is a side elevational view of the coaxial adapter illustrated in FIG. 2.
Figure 2:
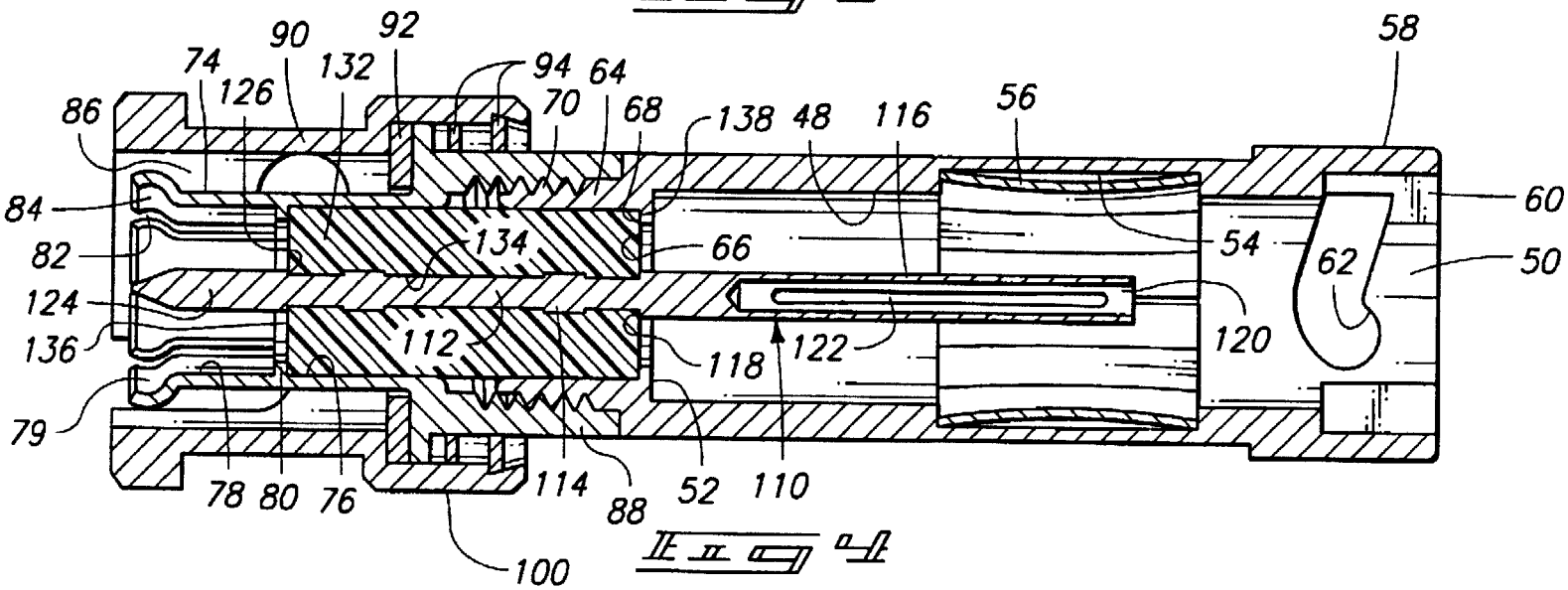
Figure 5:
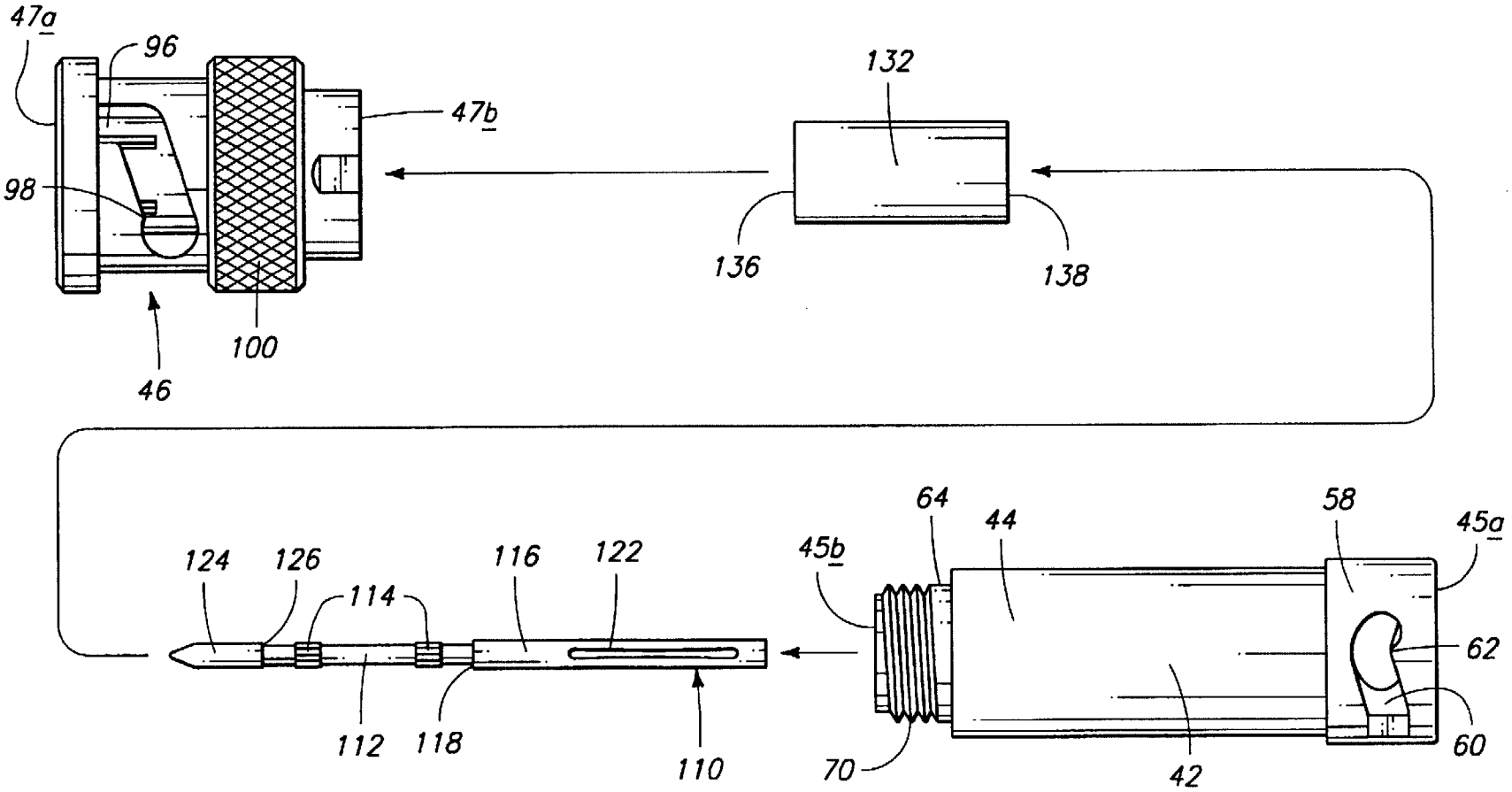
FIG. 5 is an exploded side elevational view of the coaxial adapter illustrated in FIG. 3 illustrating many of the internal components.

A preferred embodiment of the present communication coaxial patch cord adapter, is generally designated in FIGS. 2 and 3 with the numeral 40. The adapter 40 is designed to interconnect one end of a common standard mini-WECO jack plug patch cord 30 to a female BNC connector as illustrated in FIG. 2. The patch cord 30 has mini-WECO coaxial jack plugs 32 and 34 mounted at opposite ends of an intermediate coaxial patch cord cable 35. Each of the plugs 32, 34, has a outer barrel 36 and an inner coaxial plug pin 38 for normally being inserted directly into a mini-WECO patch jack.

The communication coaxial patch cord adapter 40 has an elongated housing 42 with an elongated jack sleeve section 44 at one end and a male BNC socket section at an opposite end. The jack sleeve section extends longitudinally between an outer end **45*a* and an inner end 45*b*, while the male BNC socket section extends longitudinally between an outer end 47*a* and an inner end 47*b***.

The elongated jack sleeve section 44 of the housing 42 has a cylindrical cavity 48 formed therein extending from an opening 50 at the outer end **45*a* toward the inner end 45*b* terminating at an inner cavity wall 52. The cylindrical cavity 48 in adapted to receive the barrel 36 of the plug 32, 34. A cylindrical recess 54 is formed in the wall of the cavity 48 intermediate the opening 50 and the end wall 52 to receive a contact and alignment spring 56 for engaging the other surface of the barrel 36 to provide good electrical contact and to center the barrel coaxially with the cylindrical cavity 48**.

A locking fixture 58 is formed at the outer end **45*a* to enable the adapter 40 to be releasably locked to a jack plug having a complementary bayonet fixture. The fixture 58 has a receiving groove 60 and a locking shoulder 62**.

The inner end **45*b* of the housing section 44 has a threaded portion 64 with a cylindrical cavity 66. The cavity 66 has an end wall that forms an internal shoulder 68. The threaded portion 64 has outer connecting threads 70**.

The male BNC socket section 46 of the housing 42 has a cylindrical wall 74 extending between the outer end **47*a* and the inner end 47*b*. The cylindrical wall 74 defines an inner cylindrical cavity 76 that complements cylindrical cavity 66 and an outer cylindrical cavity 78 with an end opening 79. An annular rib 80 is formed on the interior of the cylindrical wall 74, forming shoulders subdividing the cavities 76 and 78**.

The cylindrical wall 74 has slots 82 formed at the outer end **47*a* defining spring fingers 84 for receiving complementary components of the female BNC connector 24. An annular slot 86 is formed about the cylindrical wall 74 to receive a complementary component of the connector 24**.

Additionally the housing section 46 has a threaded portion 88 for mating with the threads 70 to tightly interconnect the two sections 44 and 46 when the adaptor is fully assembled. Additionally, the housing section 46 included a BNC locking sleeve 90 that is mounted on the cylindrical wall 74 for rotation relative to the wall 74 to enable the adapter 40 to be releasably locked to the female BNC connector 16 without twisting the patch cord 30.

The BNC locking sleeve 90 has a compressing ring 92 and locking rings 94 supporting and affixing the locking sleeve 90 to the cylindrical wall 74. The locking sleeve 90 has a bayonet receiving groove 96 formed therein with a locking shoulder 98 for releasably receiving and locking to a complementary bayonet fixture of the connector 16. The sleeve 90 also has a knurled gripping surface 100 for enabling the sleeve 90 to be easily rotated relatively to the housing 42.

The adapter 40 includes an elongated central coaxial shaft member 110 that extends between an intermediate shaft section 112 to a coaxial jack sleeve 116 at one end and a coaxial inner BNC male pin at the other end. The intermediate shaft section 112 has a diameter less than a diameter of the jack sleeve 116 forming an abutment shoulder 118. Further, the diameter of the intermediate shaft section 112 is also less than a diameter of the male pin 124, forming a further abutment shoulder 126.

The intermediate shaft section 112 has two sets of longitudinal ribs 114 to prevent the shaft member 110 from rotating once assembled. The jack sleeve 116 has longitudinal slots 122 formed therein to enable the jack sleeve to engage and provide good electrical contact with the jack plug pin 38.

The adapter 40 has an insulative cylindrical bushing 132 that is mounted in the cylindrical cavities 66 and 76 to support the shaft member 110. The bushing 132 has a coaxially elongated central aperture 134 formed therethrough to receive the intermediate shaft section 112 in a force fit. The ribs 114 project into an inner wall of the aperture 134 to prevent the shaft member 110 from rotating. The bushing 132 extends between ends 136 and 138.

During assembly, male pin end 124 is inserted though the aperture 134 until bushing end 138 engages abutment shoulder 118, and the bushing end 136 engages abutment shoulder 126 with the bushing 132 mounted over the intermediate shaft section 112. The bushing 132 is then inserted into cavity 66 with the bushing end 138 engaging shoulder 68 and the jack sleeve 116 extending coaxially into the jack sleeve cavity 48. The male BNC socket section 46 is then threaded to the jack sleeve section with the bushing end 136 engaging the rib 80.

Once assembled, the adapter 40 is ready to receive a patch jack plug 32, 34 in the jack sleeve section 44 and to mate the male BNC socket section 46 to the female BNC connector.

The adapter 40 is rather small in size and can easily be stored in the toolbox of the communication worker/tester, eliminating the need for the special patch cord 18.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A communication coaxial patch cord adapter for interconnecting a coaxial mini-WECO jack patch cord having a coaxial mini-WECO jack plug at one end with a piece of electrical equipment having a female BNC coaxial connector, comprising:

an elongated housing having (1) an elongated jack sleeve section with an open-ended cylindrical cavity at one end for receiving a cylindrical barrel of the mini-WECO jack plug, and (2) a male BNC socket section for mating with the female BNC coaxial connector;

a BNC locking sleeve mounted on the BNC socket section for rotating relative to the BNC socket section to releasably lock the adapter onto the BNC female connector to prevent inadvertent disconnection;

an electrically conductive elongated central coaxial shaft member;

an insulative bushing mounted within the housing supporting the central coaxial shaft member coaxially within the housing relative to the jack sleeve open-ended cylindrical cavity and the male BNC socket section;

said elongated central coaxial shaft member having (1) an intermediate shaft section supported by the insulative bushing spaced from the housing, (2) an inner jack sleeve extending outward from the intermediate shaft section to one end for receiving a central coaxial pin of the jack plug when the plug barrel is fully inserted into the jack section cylindrical cavity, and (3) an inner BNC male pin extending outward from the intermediate shaft section opposite of the inner jack sleeve to an opposite end for projecting into and being electrically connected to a complementary BNC female receptacle when the male BNC socket section is mated with the female BNC connector; and wherein the intermediate shaft section has a diameter less than a diameter of the inner jack sleeve forming an abutment shoulder and wherein the bushing has an axial aperture for receiving the intermediate shaft section with the bushing engaging the abutment shoulder to longitudinally position the bushing on the coaxial shaft member.

2. The communication coaxial patch cord adapter as defined in claim 1 wherein the inner BNC male pin has a diameter greater than the diameter of the intermediate shaft section forming a second abutment shoulder to secure and position the bushing on the coaxial shaft member.

3. The communication coaxial patch cord adapter as defined in claim 2 wherein the bushing has a length corresponding to a distance between the first and second abutment shoulders and wherein the diameter of the inner BNC male pin is less than the diameter of the inner jack sleeve to enable the bushing to be mounted on intermediate shaft section by initially inserting the inner BNC male pin through the bushing aperture until one end of the bushing engages the first abutment shoulder and the other end of the bushing engages the second abutment shoulder.

4. The communication coaxial patch cord adapter as defined in claim 1 wherein the bushing has a axial aperture receiving the intermediate shaft section and wherein the intermediate shaft has ribs formed thereon to engage the bushing to prevent the coaxial shaft member from rotating relative to the bushing.

5. The communication coaxial patch cord adapter as defined in claim 1 wherein the elongated jack sleeve section has a bayonet locking fixture adjacent the open end of the cylinder for receiving and releasably locking the adapter to a jack plug having a complementary bayonet jack plug fixture.

6. The communication coaxial patch cord adapter as defined in claim 1 wherein the male BNC socket section of the housing is threadably connected to the elongated jack sleeve.

7. The communication coaxial patch cord adapter as defined in claim 1 wherein the elongated jack sleeve section and the male BNC socket section of the housing have complementary internal shoulders for engaging opposite ends of the bushing to secure and longitudinally position the bushing and the coaxial shaft member relative to the housing.

8. The communication coaxial patch cord adapter as defined in claim 1 wherein the coaxial shaft member is formed as an unitary element.

* * * * *